United States Patent [19]

Toyama

[11] Patent Number: 4,700,606

[45] Date of Patent: Oct. 20, 1987

[54] RECORDERS

[76] Inventor: Nobuo Toyama, 2-39-1 Sakuragaoka, Tama-shi, Tokyo, Japan

[21] Appl. No.: 947,618

[22] Filed: Dec. 30, 1986

[51] Int. Cl.[4] ..... G10D 7/02

[52] U.S. Cl. ..... 84/380 C; 84/453

[58] Field of Search ..... 84/380 R, 380 C, 383 R, 84/384, 398, 399, 453

[56] References Cited

U.S. PATENT DOCUMENTS

| | | | |
|---|---|---|---|
| 3,224,315 | 12/1965 | Guinness | 84/383 R |
| 3,643,538 | 2/1972 | Toyama | 84/384 |
| 3,750,521 | 8/1973 | Dolmetsch | 84/380 C |
| 3,869,955 | 3/1975 | Yamaguchi | 84/380 C |
| 4,529,865 | 7/1985 | Oakes | 84/453 X |

*Primary Examiner*—Lawrence R. Franklin

*Attorney, Agent, or Firm*—Frishauf, Holtz, Goodman & Woodward

[57] ABSTRACT

A recorder wherein moisture condensation in the windway due to temperature difference between the windway itself and the breathing passing therethrough is prevented, so that the sound will not be blocked by the moisture adhering to the windway during performance.

A heating means is attached to a tube member of the windway unit to reduce the temperature differences between the windway and the breathing blown into the windway to minimum to thereby prevent moisture condensation. When there is no moisture condensation in the windway, there will be no turbulence in the breath blown through the windway, assuring adequate amount of breathing to be supplied from the outlet to correctly act on the edge of a sounding window.

3 Claims, 4 Drawing Figures

RECORDERS

BACKGROUND OF THE INVENTION

1. Field of the Invention

The present invention relates to an improvement on a recorder made of synthetic resin, and more particularly, to a recorder which is free from defects otherwise encountered in woodwinds of this type that the tone quality as well as volume is reduced due to moisture condensation inside the windway.

2. Description of the Prior Art

Woodwinds in general and recorders, in particular, made of synthetic resin comprise a mouthpiece unit having a windway inside and an instrument body having plural tone holes. When a player breathes into the windway via the mouthpiece, his breaths act on the edge of the sounding window located beyond the windway to create sounds.

The windway inside the mouthpiece has an elongated rectangular cross section as if surrounded by walls on four sides and extends longitudinally along the mouthpiece unit for a predetermined length. The edge of the sounding window which opposes to the outlet of the windway has a width corresponding to the sectional configuration of the windway and a predetermined inclination when viewed from side. The positional relation of the outlet of the windway with the tip of the edge is of a great importance in generating tones correctly. Even a very slight deviation in the positional relation would result in wrong volume and quality of tones.

It often happens during performances, however, that correct tones in adequate volume can not be obtained even if said positional relation is correctly designed. This is mainly due to the fact that the moisture contained in warm breath becomes condensed when it contacts the wall of the windway which is lower in temperature than the breath. In other words, when the temperature difference between the warm breath and the inner wall of the windway is great, water vapor contained in the breath is cooled and becomes condensed by the windway wall. Dews or water drops formed on the wall reduce the cross sectional area of the windway, and create turbulences in the breath passing through the windway, or hampers the correct flow of breath corresponding to the adequately designed cross sectional area of the windway, making it difficult to obtain adequate flow of breath against the edge.

When dews collect inside the windway during a performance, the player must vigorously breath into the mouthpiece while closing the sounding window located beyond the mouthpiece unit with a hand to blow out the collected dews when he is not playing the instrument. This causes tremendous inconveniences.

Various proposals have heretofore been made to overcome the problem of moisture condensation in the windway of recorders. For example, U.S. Pat. Nos. 3,643,538 and 3,750,521 disclose recorders in which the windway provided in the mouthpiece unit is structured by a thin-walled member of a material different from that of the mouthpiece unit so that a space can be formed between the two members to shut off the cold ambient air from contacting directly with the inner wall of the windway.

Although the above construction does prevent the moisture condensation in the windway to some extent, it is not possible to completely prevent the condensation in the windway of which temperature is essentially different from that of breath, considering that the warm breath is constantly blown into the windway. In this sense, the conventional recorders do not fully overcome the problem of condensation and inconveniences caused thereby.

SUMMARY OF THE INVENTION

An object of the present invention is to solve the problem of moisture condensation in the windway of a recorder. The invention is characterized in that a heating means is provided on the outer periphery of a thin wall which defines the windway within the mouthpiece unit and is distanced with an interval from the member constituting the mouthpiece unit. With said means heating the outer periphery of the windway, whenever necessary, the windway can be maintained at a temperature substantially the same with that of the breath which is constantly blown into the windway, assuring prevention of the moisture condensation arising from temperature differences.

Suitable heating means to be provided on the outer periphery of the windway may include a heating member utilizing the electric resistor, or a chemical pyrogenic member utilizing the thermal energy of oxidation.

THE PREFERRED EMBODIMENTS OF THE INVENTION

Figure 1:
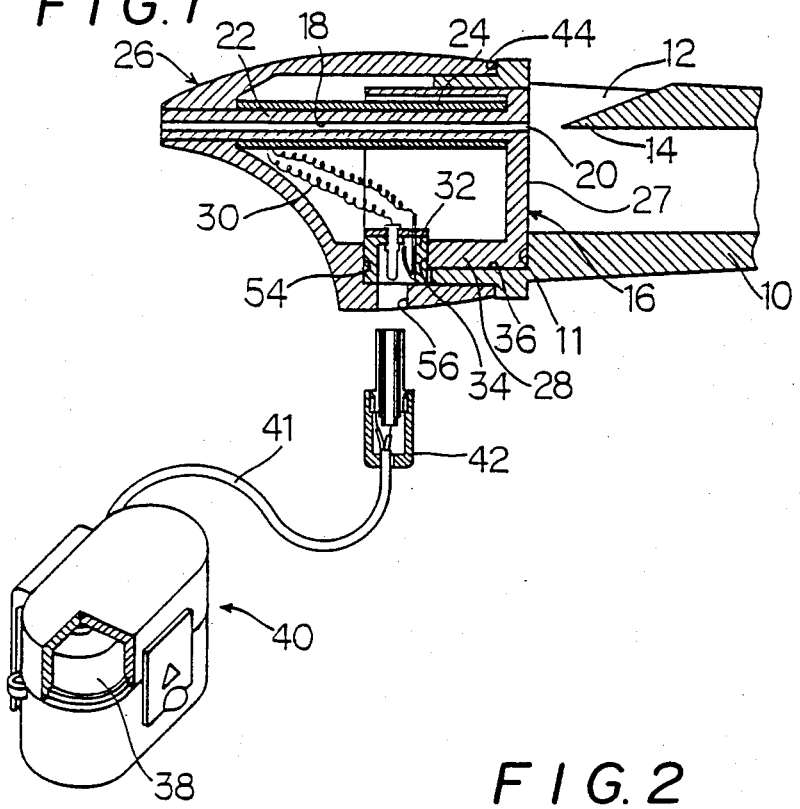
FIG. 1 is a vertical sectional view to show the construction of a preferred embodiment of a recorder according to the present invention.

Preferred embodiments of a recorder according to the present invention will now be described referring to the accompanying drawings. As shown in FIG. 1, the recorder according to the present invention comprises an instrument body 10 and a mouthpiece unit 26 connected to the instrument body 10 at its tip, said mouthpiece unit 26 having a windway unit 16 in its inside. Since the instrument body 10 is identical with those found in the conventional recorders, it is not shown in the drawing. It should be noted, however, that the body extends toward the right in FIG. 1 and has plural tone holes at predetermined positions.

The windway unit 16 comprises a tube member 22 which defines a windway 18 of a flat rectangular section, and a cylindrical member 28 which is connected to one end of the instrument body 10 via a wall 27, the cylindrical member 28 facing the same direction as the tube member 22. The cylindrical member 28 has such an outer diameter that the member 28 can be inserted in an opening 36 provided at the tip of the instrument body 10 and is shielded by said wall 27. At a farther end of the opening 36 in the instrument body 10 which receives the cylindrical member 28 has a stepped portion 11 to receive the wall 27. The stepped portion 11 holds the cylindrical member 28 of the windway unit 16 securely in position at the tip of the instrument body 10. As a result, an outlet 20 of the windway 18 bored in the wall 27 and an edge 14 of a sounding window 12 in the instrument body 10 will come into the correct positional relation with each other to give sound in accurate tone and volume.

The tube member 22 of the windway unit 16 is sheathed with a heating means 24 of a resistor about its outer periphery to heat the member 22 externally. The heating means 24 may be an insulating member embedded with a heating element such as wire, a print circuit made of heat-resistant synthetic resin provided with a carbon type resistor, etc.

Figure 2:
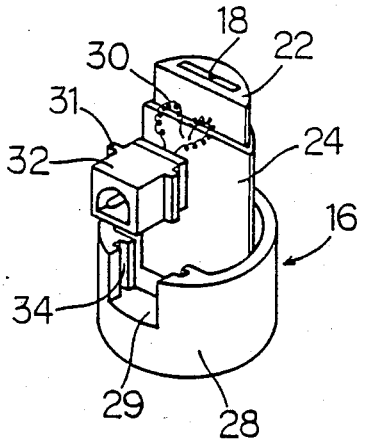
FIG. 2 is a perspective view of the recorder shown in FIG. 1 to explain the structure of the windway unit.

As shown in FIG. 2, a notch 29 is provided in the cylindrical member 28 of the windway unit 16 at its open end to allow mounting of a plug receptacle 32 therein. The plug receptacle 32 has a lead wire 30 extending therefrom and connecting with the heating means 24. A dent 34 each is provided on both sides of the notch 29, and a projection 31 provided on both sides of the receptacle 32 mates with said dent 34, whereby the receptacle 32 securely rests in the notch 29 in the cylindrical member 28.

Referring to FIG. 1, a plug 42 extending via a lead wire 41 from a portable power source 40 encasing a battery 38 removably connects with said receptacle 32 to supply power to the heating means 24 from the battery 38.

Figure 3:
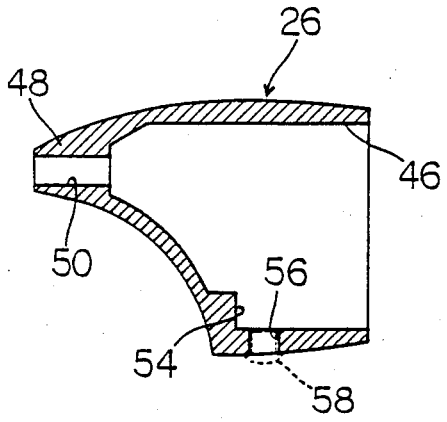
FIG. 3 is a sectional view to show the mouthpiece unit of the recorder shown in FIG. 1.

The mouthpiece unit 26 has an opening 46 at its one end which fits over the outer periphery of the instrument body 10 at its tip as shown in FIG. 3. The other end of the mouthpiece unit 26 is formed as a mouthpiece 48 in the shape of a beak. An aperture 50 is bored in the mouthpiece 48 to securely receive the tip of the tube member 22 of the windway unit 16. At the lower portion of the opening 46 in the mouthpiece unit 26 is formed a stepped portion 54 to securely hold the receptacle 32 attached to the cylindrical member 28 of the windway unit 16 as the receptacle 32 comes in contact with the stepped portion with its side. A through-hole 56 is provided in the lower side of the opening 46 of the mouthpiece unit 26 to allow said plug 42 to pass.

As shown in FIG. 1, the end of the mouthpiece unit at the opening 46 rests on a stepped portion 44 made at the outer periphery of the instrument body at its tip. Further, the aperture 50 of the mouthpiece 48 receives the tube member 22 of the windway unit 16 at its tip. In this manner the mouthpiece unit 26 is securely attached to the instrument body 10. As the stepped portion 54 provided in the mouthpiece unit 26 comes in close contact with the side of said receptacle 32, the through-hole 56 for allowing the plug 42 will come in correct alignment with the receptacle 32 attached to the cylindrical member 28 of the windway unit 16.

When the ambient temperature is low such as in winter, the plug 41 of the power source unit 40 is plugged into the receptacle 32 in the windway unit 16 via the through-hole 56 provided in the mouthpiece unit 26 to supply power to the heating means 24 provided about the outer periphery of the tube member 22. As the heating means 24 generates heat upon power supply, the temperature of the tube member 22 rises to reduce the temperature difference created by the warm breath blown into the windway 18 via the mouthpiece 48. When the temperature of the breath passing in the windway and that of the windway itself become the same, there will be no moisture condensation in the windway 18, allowing adequate amount of breath to act on the edge 14 of the sounding window located beyond the windway 18 to thereby create sound in correct tones and adequate volume.

A sensor for temperature may preferably be provided in the heating means 24 for the tube member 22, in order to automatically suspend the power supply from the source 40 and prevent abnormal temperature rise in the tube member 22 when the temperature rises excessively.

After a performance, the plug 42 is pulled out from the instrument. As the through-hole 56 in the mouthpiece member 26 will remain uncovered when the plug is removed, it is preferable to use a cap 58 to protect the same against dust.

Figure 4:
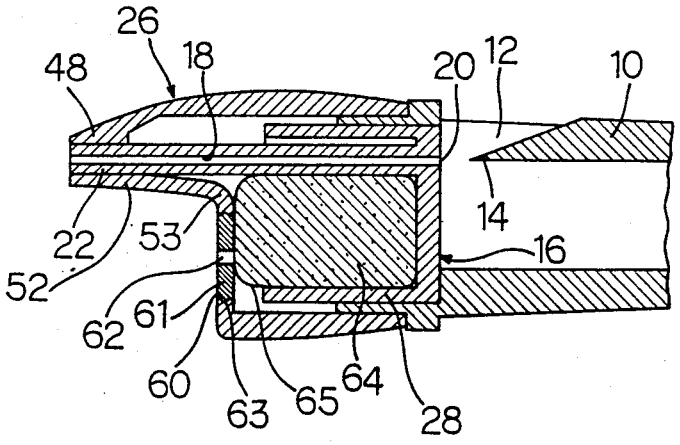
FIG. 4 is a sectional view to show the essential parts of another embodiment of the present invention.

FIG. 4 shows another embodiment according to the present invention. The recorder according to the second embodiment uses a heating means 64 utilizing the heat of chemical oxidation to heat the tube member 22 of the windway unit 16. As has been explained with respect to the embodiment shown in FIG. 1, the windway unit 16 is retained inside the mouthpiece unit 26 by means of the cylindrical member 28. A space is provided between the tube member 22 and the mouthpiece unit 26. One particular feature of the preferred embodiments lies in a space of relatively large capacity which is formed at the bottom of the tube member 22 inside the cylindrical member 28. In the mouthpiece unit 26 of the embodiment shown in FIG. 4, the portion of the wall with a big inward curve which extends from the lower side of the mouthpiece 48 at the tip to the lower side of the cylindrical opening 46 is bent substantially at the right angle to form a corner 55. The vertically extending portion of the wall 52 is bored with a window 60. A lid 61 provided with an aperture 62 for air will detachably snap into the window 60 by means of a snap 65. The lid 61 is removed from the window 60 by pulling a small hook, etc. which is inserted in the air hole 62 in order to insert the heating means 64 inside the cylindrical member 28. The pyrogenic substance 64 is placed inside an air permeable bag 65 so that the pyrogenic substance and the oxygen contained in the air will react to generate heat by oxidation. The pyrogenic substance is packed in the bag 65 and then placed in an air-tight film bag (not shown) before use. In placing the heating means 64 inside the cylindrical member 28, one must take out the permeable bag 65 containing the pyrogenic substance from the air-tight bag, shake the bag well to let the air permeate into the substance in the bag, slip the bag inside the cylindrical member 28 and close the window 60 with the lid 61. The air required for oxidation of the pyrogenic substance can be supplied through the air supply hole 62 of the lid 61.

The air supply hole 62 may be an orifice in which the edge of a coin may be inserted to screw the lid 61 into the window 60.

Reduced manufacturing cost and easier handling may be expected from the second embodiment using such a chemically pyrogenic substance as the heating means 64 because of its simplified structure.

As has been described in the foregoing, the recorder according to the present invention is characterized in that moisture condensation in the windway caused by the breath can be adequately prevented as the windway is positively heated from outside by a heating means which is provided in a space between the tube member defining the windway and the member constituting the mouthpiece unit. As a result, even during a prolonged performance or in a cold environment such as during winter, adequate amount of breath can be conveyed to the edge of the sounding window located behind the windway to give sound in accurate tones and adequate volume. The recorder according to the present invention eliminates the troublesome operations of blowing out condensed dew drops from the windway during intervals, assuring the player a stable and pleasant performance.

It should be noted that the present invention is in no way limited to the embodiments in the foregoing description. Various modifications and designs are possible without departing from the scope and spirit of the invention: e.g. a different heating means other than described by way of the embodiments can be used; or the assembling structure of the windway unit and the mouthpiece unit can be modified.

What is claimed is:

1. A recorder made of synthetic resin comprising a mouthpiece unit inside which a windway unit having a tube member defining a windway is arranged in a manner such that the outlet of the windway is positioned corresponding to the edge of a sounding window, characterized in that the tube member of the windway unit has a heating means attached thereto for heating and maintaining the windway inside the tube member to a temperature substantially the same as the temperature of the breath blown through the windway.

2. The recorder as claimed in claim 1 wherein said heating means for the tube member of the windway unit is a heat generating member including an electric resistor which is arranged about the outer periphery of the tube member and which generates heat when supplied with power from a source provided separately outside the instrument.

3. The recorder as claimed in claim 1 wherein said heating means for the tube member of the windway unit is an oxidizable chemical pyrogenic substance which is contained in a permeable bag provided in a space provided at the outer periphery of the tube member to thereby utilize the thermal energy generated by oxidation of the chemical pyrogenic substance for heating the tube member in the windway unit.

* * * * *